United States Patent [19]

Platek et al.

[11] Patent Number: 4,545,423

[45] Date of Patent: Oct. 8, 1985

[54] REFRACTORY COATING OF EDGE-DAM BLOCKS FOR THE PURPOSE OF PREVENTING LONGITUDINAL BANDS OF SINKAGE IN THE PRODUCT OF A CONTINUOUS CASTING MACHINE

[75] Inventors: Stanley W. Platek, Essex Junction; S. Jerry Desautels; Wojtek Szczypiorski, both of Colchester, all of Vt.

[73] Assignee: Hazelett Strip-Casting Corporation, Colchester, Vt.

[21] Appl. No.: 493,359

[22] Filed: May 10, 1983

[51] Int. Cl.[4] ..... B22D 11/06

[52] U.S. Cl. ..... 164/481; 164/138; 164/431; 164/485

[58] Field of Search ..... 164/138, 418, 430–432, 164/443, 481, 485; 75/230; 419/10

[56] References Cited

U.S. PATENT DOCUMENTS

| | | | |
|---|---|---|---|
| 3,871,905 | 3/1975 | Petry | 427/292 |
| 3,937,270 | 2/1976 | Hazelett et al. | 164/432 |
| 4,027,716 | 6/1977 | Theobald et al. | 164/481 |
| 4,039,297 | 8/1977 | Takenaka | 75/230 |
| 4,155,396 | 5/1979 | Dompas et al. | 164/431 |

*Primary Examiner*—Nicholas P. Godici
*Assistant Examiner*—Richard K. Seidel
*Attorney, Agent, or Firm*—Parmelee, Bollinger & Bramblett

[57] ABSTRACT

Continuous casting methods and apparatus are described wherein a defect in the cast surfaces consisting of longitudinal bands of sinkage, sometimes called "sinks", which are spaced relatively far inwardly from the edges of wide, relatively thin slab or strip, usually being spaced inwardly away from the edges by a distance of 3 to 7 times (sometimes up to 9 times) the thickness of the cast slab, is practically eliminated by means of a coating or covering of non-wettable refractory ceramic material of low heat conductivity applied to the inner faces of the edge-dam blocks for reducing heat flow out of the edges of the slab or strip being cast. Numerous such blocks are strung onto a flexible metal band or cable to constitute each of the two edge dams which define the edges of the mold space. Alternative methods for reducing heat flow from the edges of the slab or strip being cast are disclosed—notably the breaking of thermal contact by means of jiggling by rocking individual edge-dam blocks back and forth; also the use of sintered edge-dam blocks, and the heating of the edge-dam blocks along the casting region. One or more of these alternative methods may be used in conjunction with the coating of refractory material on the inner faces of the edge-dam blocks for further reducing or controlling the flow of heat out of the margins of the metal being cast into the edge-dam blocks.

36 Claims, 11 Drawing Figures

REFRACTORY COATING OF EDGE-DAM BLOCKS FOR THE PURPOSE OF PREVENTING LONGITUDINAL BANDS OF SINKAGE IN THE PRODUCT OF A CONTINUOUS CASTING MACHINE

BACKGROUND OF THE INVENTION

A. Field of the Invention

In continuous metal casting machines such as twin-belt casting machines, the molten metal being cast is fed into a casting region between opposed portions of a pair of revolving flexible, liquid-cooled belts, the liquid coolant usually being water containing rust inhibitors. The moving belts, in cooperation with moving side dams(often called "edge dams"), confine the molten metal between them and carry the molten metal along as it solidifies. Spaced back-up rollers having narrow ridges support the belts and also guide the belts as they move along through the casting region. The large quantities of heat liberated by the molten metal as it solidifies are withdrawn through those portions of the belts and side dams which are adjacent to the metal being cast.

Each of the two flexible casting belts revolves around a belt carriage in a path defined by main pulleys located in the carriage around which the belt passes. In some twin-belt casting machines there are two main pulleys at opposite ends of the carriage defining a racetrack path for the belt to travel. Other twin-belt casting machines have three or more main pulleys in each carriage defining the belt path.

The molten metal in the input region of a twin-belt machine may advantageously be shrouded with inert gas by means of suitable application techniques, while at the same time using the inert gas for purging the approaching casting belts of reactive gases, as disclosed in copending U.S. patent application Ser. No. 372,459 of Robert Wm. Hazelett, Charles J. Petry and Stanley W. Platek dated Apr. 28, 1982 and assigned to the same assignee as the present invention.

For further information about twin-belt casting machines in general, the reader may refer to one or more of the following U.S. Pat. Nos. 2,640,235; 2,904,860; 3,036,348; 3,041,686; 3,123,874; 3,142,873; 3,167,830; 3,228,072; 3,871,905; 3,937,270; 4,002,197; and 4,082,101.

The present invention particularly concerns the side dams or edge-dam blocks in the above-described casting machines. These side or edge dams are assembled from multiplicity of blocks which, for instance, may be slotted and strung onto a flexible metal strap as described in U.S. Pat. Nos. 2,904,860; 3,036,348; and 3,955,615. In place of the metal strap, metal cables have also been used.

B. Prior Art

Prior art, notably that of belt preheating as described in U.S. Pat. Nos. 3,937,270; 4,002,197; and 4,082,101 has improved the overall shape, soundness, and metallurgy of strip or slab cast continuously between twin flexible belts. Also, belt coating consisting of resins containing fillers of finely divided insulating or finely divided particles of refractory materials have proved helpful, as described in U.S. Pat. No. 3,871,905. The heat transferred to the belts from the freezing or solidifying metal would cause temporary longitudinal flutes (transversely spaced hills and valleys), which were observed to be wide and deep in both the product being cast and in the casting belts themselves. The above-mentioned techniques controlled this belt distortion problem.

In spite of apparently solving the belt-distortion problem, shallow, straight, longitudinal "sinks" appeared in the top of the slab or strip. The sinks would run continuously and were centered typically at a distance of three to seven times (and sometimes up to nine times) the slab thickness from either edge, independent of the width of the slab being cast. The resulting deformed or distorted cross-section has been referred to as a "dog-bone" shape or phenomenon. This dog-bone problem, though not so dramatic in appearance in the cast slab as the longitudinal flutes caused by belt distortion, is nevertheless a significant barrier to the attainment of product of high quality. The present invention solves the dog-bone problem by eliminating or substantially eliminating such longitudinal sinks, and therefore, this invention opens up important new applications for continuous casting in twinbelt casting machines.

SUMMARY OF THE INVENTION

The present invention relates to continuous casting methods and apparatus wherein the edge-dam blocks which define the edges of the space within which wide, thin slab is cast are coated or covered on their inner faces with a non-wettable refractory ceramic material of low heat conductivity. Related improvements to reduce heat transfer out of the edges of the wide, thin slab being cast are disclosed which likewise improve the shape, soundness, and metallurgy of the cast metal product, notably jiggling or heating the dam blocks along the casting region, or making them of sintered, partly non-metallic material. One or more of these related improvements may be used in conjunction with the coating of refractory material onto the inner faces of the edge-dam blocks.

DESCRIPTION OF THE PREFERRED EMBODIMENT

In the continuous casting of wide strip or slab, the heat transfer and rate of freezing at the edges has been inordinately high, owing mainly to the extraction of heat locally from three directions, not just two. This condition has interfered with the shape, soundness, and metallurgical quality of the cast product in the area adjacent to the edges. The present invention advantageously slows the rate of heat transfer from the cast metal to the edge-dam blocks as compared with prior art practices. We have found that the addition of a ceramic-type coating to the metallic dam blocks on their inner faces where they contact the molten metal slows the local rate of freezing of the metal to be cast, resulting in balanced heat extraction and improved product.

The slowing of the rate of freezing at the edges of the product in accordance with the invention can be accomplished by other means. These include the use of sintered edge-dam blocks with partly non-metallic composition, deliberately heating the blocks, and jiggling the blocks in order to break close thermal contact with the freezing product.

It should be noted that the slowing of heat transfer through the edges is not always desirable. For example, continuously cast copper bar for the manufacture of rod intended to be drawn into wire is not much wider than it is thick. Rapid heat extraction through the thick edges of such a continuously cast bar product for making wire promotes fine grain structure, which is there more important than the present considerations which apply to a relatively wide strip or slab, namely a cast product having a width-to-thickness ratio of at least four-to-one. Hereafter, the term "strip" or "slab" will be understood as being intended to mean a cast product having a width to thickness ratio of at least 4 to 1. The cast metal product will preferably have a thickness of between ¼ inch (6 mm) and 3 inches (75 mm) and a width at least four times its thickness.

The solution to the problem of longitudinal bands of sinkage (longitudinal "sinks") causing dog-boning deformation of the relatively wide slab or strip being cast, such bands of sinkage being hotter than the remainder of the slab or strip, may superficially appear to be readily apparent, namely, the application of a layer of refractory insulation to the inner faces of the edge-dam blocks where they contact molten metal. However, the dog-bone sinkage bands are located relatively far inward in the slab away from the side dams, and the solution to the dog-bone phenomenon was by no means simple or obvious to those skilled in the art, as will become clear from the following discussion. It is noted that twin-belt casting machines have been in use for many years at many different locations throughout the world for continuously casting relatively wide strip or slab, and the dog-bone phenomenon has been encountered by many experts in the field of continuous casting without previously being solved.

Figure 1:
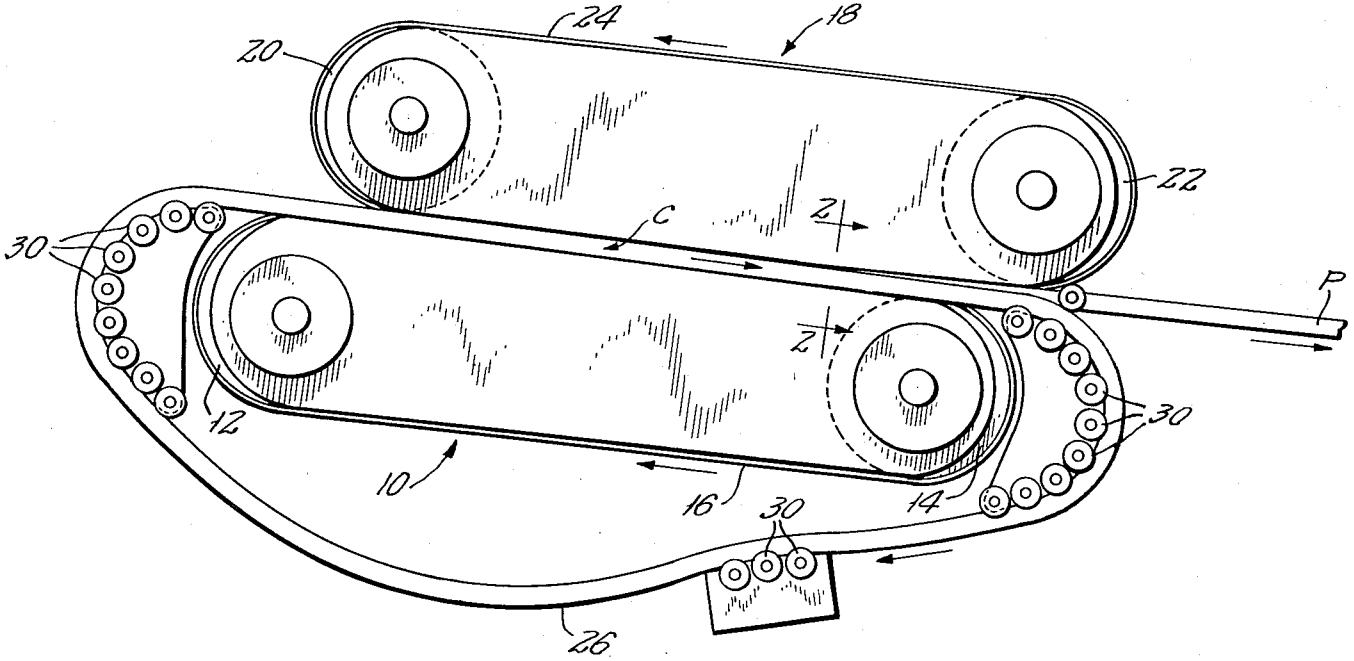
FIG. 1 is a side elevational view of the casting zone, the casting belts and pulleys, and one of the casting side dams in a twin-belt continuous casting machine.

With reference to FIG. 1, a twin-belt continuous casting machine includes a lower carriage 10 which carries pulleys 12, 14 around which revolves a lower casting belt 16. Pulley 12 is located at the input or upstream end of the machine and pulley 14 is at the output or downstream end of the machine. An upper carriage 18 carries pulleys 20, 22 around which revolves an upper casting belt 24. A moving casting mold is defined by and between the lower casting belt 16 cooperating with a pair of spaced casting side dams 26 and 28 (FIGS. 2 and 3) and with the upper casting belt 24 as they are conducted together along casting zone C. The side dams are guided by rollers 30. The upper carriage may be lifted for access in the usual manner. Finned backup rollers 32 (FIG. 2) define the position of the belts in casting zone C. For other details concerning twin-belt casting machines, reference may be made to the aforementioned patents.

Figure 2:
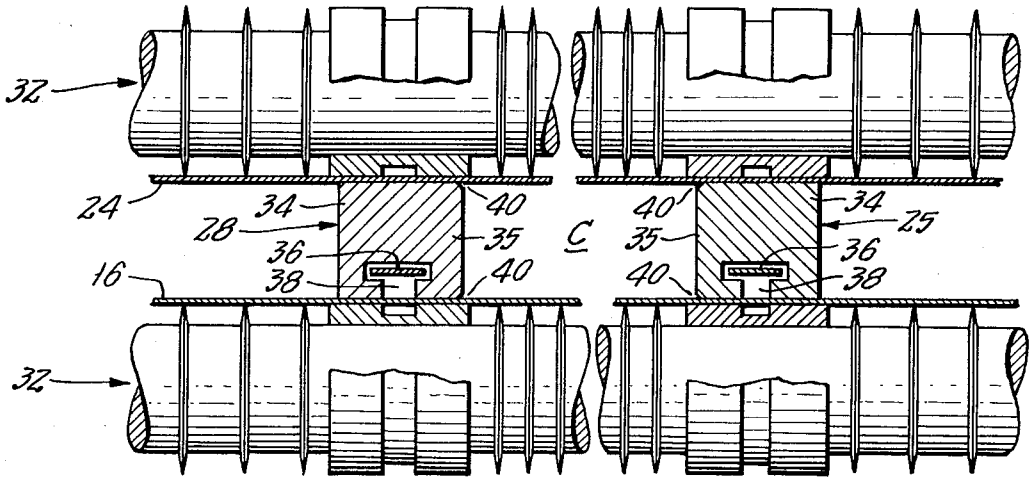
FIG. 2 is an enlarged cross-sectional view taken substantially along the plane 2—2 of FIG. 1 illustrating the casting space, the edge dams, and the backup rollers.
Figure 3:
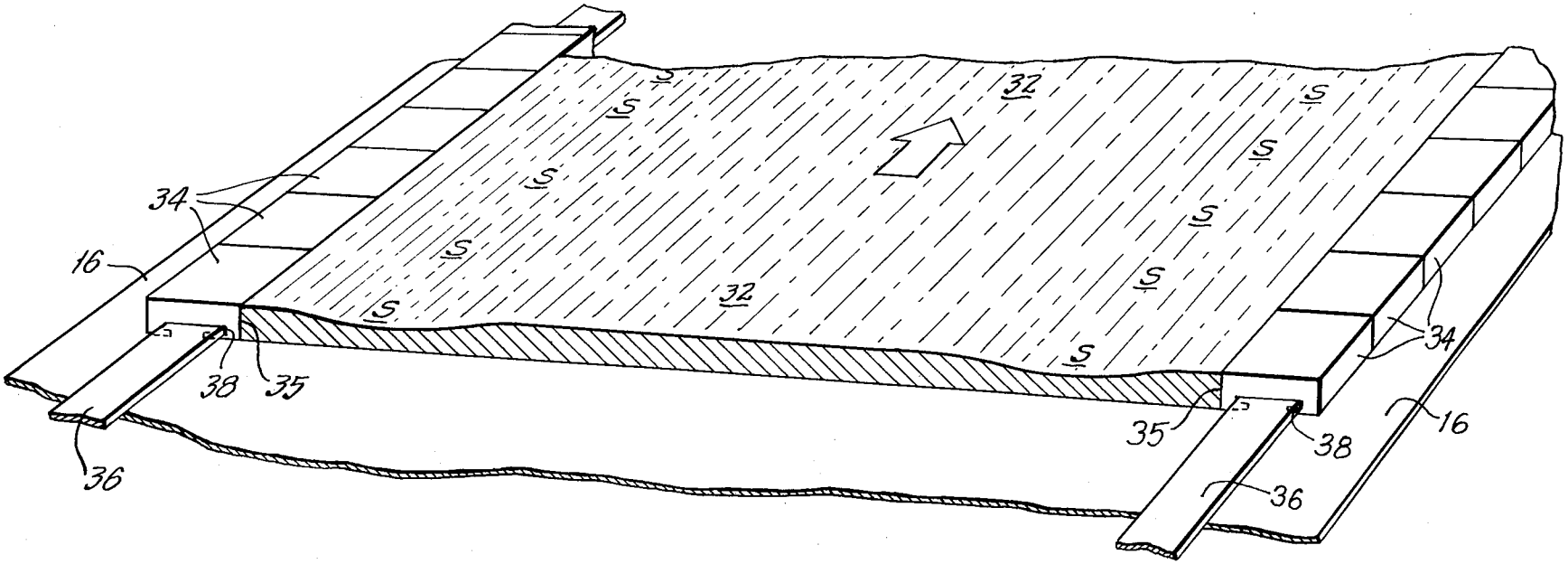
FIG. 3 is a perspective view looking down on a typical slab with the upper belt removed, showing the cross-sectional "dog-bone" shape or profile of a slab cast without the present invention. The vertical irregularities are exaggerated.
Figure 4:
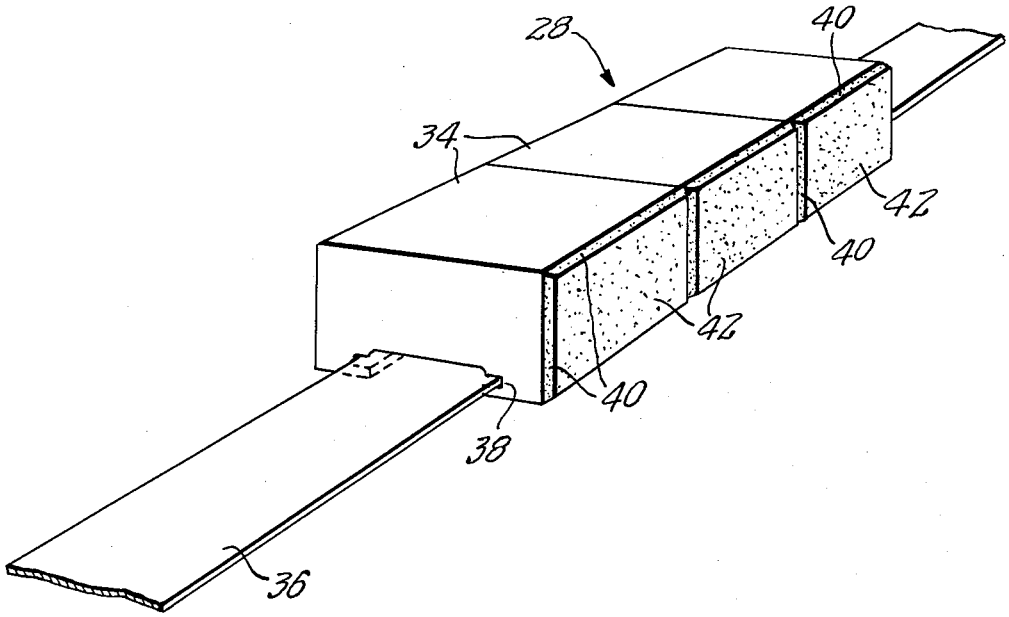
FIG. 4 is an oblique view of a few edge-dam blocks in accordance with the present invention, mounted on the flexible metal band that unites these blocks into an endless strand.

Each of side dams 26 and 28 comprises a multiplicity of slotted dam blocks 34, which are shown in FIGS. 2, 3, and 4 strung on a flexible endless metal strap 36. The strap is usually stainless steel. Blocks 34 have substantially parallel opposing inner surfaces or faces 35 (FIGS. 2 and 3). The height of the dam blocks is determined by the desired thickness of the cast product. Each of blocks 34 has a generally T-shaped slot 38, extending completely through the length of the block adjacent the bottom face thereof. Each of side dams 26 and 28 is constructed by sliding numerous slotted dam blocks 34 onto the strap 36. Further details on side or edge dams may be found in U.S. Pat. Nos. 2,904,860; 3,036,348; and 4,260,008.

In the present practice of the continuous casting of aluminum and metals of lesser melting point, the preferred practice is to use dam blocks 34 made of common machinery steel such as 1018 steel, which can be lightly carburized. For metals of higher melting point, such as copper and its alloys, dam blocks made from special bronze alloys as described for example in U.S. Pat. Nos. 4,239,081 and 4,260,008 are preferred to be used.

To carry out the present invention, the four edges of the mold side (inner face) 35 (FIGS. 2, 3) of the dam blocks 34, the vertical inner edges and those contacting the upper and lower belts are preferably slightly chamfered as at 40 in FIGS. 2 and 4. Any oily residue resulting from machining of the blocks must be effectively removed from the dam blocks. This removal of oily residue is especially important for bronze-type dam blocks, where heating is a satisfactory method for such removal.

Next, the chamfered dam blocks are locked in a frame or "chase" and grit-blasted on one vertical face, namely the inner face 35 where a refractory coating 42 is to be applied, that is, on the face which will contact molten metal. For such grit-blasting 20-grit aluminum oxide has been used to advantage applied at an air pressure of 40 to 50 psi (about 300 kilopascals).

Next, by flame spraying there is applied to the grit-blasted face a layer of nichrome refractory metal alloy (80 Ni-20Cr by weight) to a thickness of roughly 0.006 of an inch (0.15 mm). The flame-spraying process utilizes an oxyacetylene flame plus compressed air to melt and spray materials of high melting point, even as high as 4700° F. (2593° C.).

Next, a refractory insulative ceramic layer is applied. A successful insulative refractory ceramic is zirconium oxide, $ZrO_2$, also called zirconia. While deposits of up to at least 0.025 inch (0.63 mm) are useful, the preferred deposited thickness of this insulative refractory ceramic is about 0.010 inch (0.25 mm). This thickness of the insulative refractory ceramic of about 0.010 inch, plus the thickness of the underlying refractory metal alloy of roughly 0.006 of an inch as previously described, provides a preferred total thickness of roughly 0.016 inch (0.40 mm) of fused dual-layer refractory coating over the peaks of the underlying grit-blasted metal surface. A purity of about 95 percent in the zirconia has been successful. The minimum useful thickness of the zirconia is about 0.004 of an inch. Flame spraying requires adequate ventilation. Silica may also be used as the insulative refractory ceramic, but zirconia is preferred as being more effective.

The resulting fused dual-layer refractory coating is fused together as a unitary coating or monolithic covering. The blocks must, therefore, be carefully removed from the "chase" or frame, to avoid chipping the edges of the coating on the blocks when separating each block from its neighbor. Breaking the coating at the joints by carefully bending the chamfered vertical edges 40 of the blocks apart is preferable. Any remaining localized ragged places along the chamfered edges 40 need to be smoothed, to avoid spalling or chipping during service.

Case hardening of the coated dam blocks as by nitriding to reduce wear is preferred. Such case hardening may be done on the coated dam blocks without masking. Alternatively, the dam blocks can be nitrided before coating at 42. Then, the hard case is locally machined off of the inner faces 35 before the grit-blasting and coating 42.

DETAILED RESULTS OF THE INVENTION

The overall result of this invention is appreciably to improve the cast slab or strip material P, mainly in order that it will emerge without longitudinal sinks or hot bands S (FIG. 3) associated with the dog-bone configuration. Sinks S may cause (1) local loss of contact with the water-cooled casting belts 24 and/or 16, which loss of contact in turn is apt to cause locally the following problems: namely (2) remelting of the metal constituents of lower melting point from the surface at S, with (3) consequent segregation and porosity, causing in turn (4) streaks of mold staining and (5) bands of weakened material, which may crack or sliver in the rolling mill or even at the pinch rolls (not shown) downstream from the caster. This cracking or slivering problem is due to the segregation and porosity. Problems (2), (3), and (4) can be lessened by reducing the linear casting speed below that which would be possible except for the occurrence of the sinks or hot bands S. However, this lessening of linear casting speed is at the expense of (6) reduced production, together with other problems associated with allowing the non-sunken and better-cooled portions of the strip or slab to enter the rolling mill too cold. Such resulting coldness (7) usually prevents the rolling of the cast strip or slab from knitting or curing its porosity, especially centerline porosity (mid-way between top and bottom surfaces), which is generally present. Moreover, the same condition of undue coldness (8) during rolling prevents the beneficial breaking up and reduction in size of grain structure. Finally (9), sinks S directly interfere with the basic mechanical rolling process: thicker portions are therein proportionately squeezed more but are restrained from growing longitudinally by the thinner portions S which are proportionately squeezed less, thus causing rippling of the originally thicker parts in addition to destructive shear stresses.

The avoidance of sinks S by employing the present invention advantageously tends to solve or substantially eliminate all of these problems.

The present invention may be employed most advantageously when belt preheating is used—that is, the procedure of heating each successive section of each casting belt 16 or 24 that is momentarily approaching the casting region C. Such preheating serves thermally to expand the belt to about the same degree as it will be when the hot molten metal contacts it. This preheating avoids the distortion that would be occasioned by the thermal shock of suddenly encountering the heat of the molten metal.

EXAMPLE I (PRIOR ART)

The test herein described utilized belt preheating, in the continuous casting of an aluminum slab of thickness about 0.600 inch. The dam blocks were made of steel. Belt preheating is described in U.S. Pat. Nos. 3,937,270 and 4,002,197. The preferred method and apparatus for belt preheating using steam fed through tubes is described in copending application Ser. No. 199,619 filed Oct. 22, 1980 in the names of R. William Hazelett and J. F. Barry Wood and which is assigned to the same assignee as the present invention. It was the latter preferred method and apparatus using steam fed through tubes which was used in the test described below.

This example is a continuously cast slab of a nominal thickness of about 0.600 of an inch of aluminum alloy 3105, where the occurrence of sinkage S in a typical cross section (FIG. 5) measured 0.014 inch maximum (0.35 mm) using dam blocks in accordance with the prior art, which lacked effective insulation.

Figure 5:
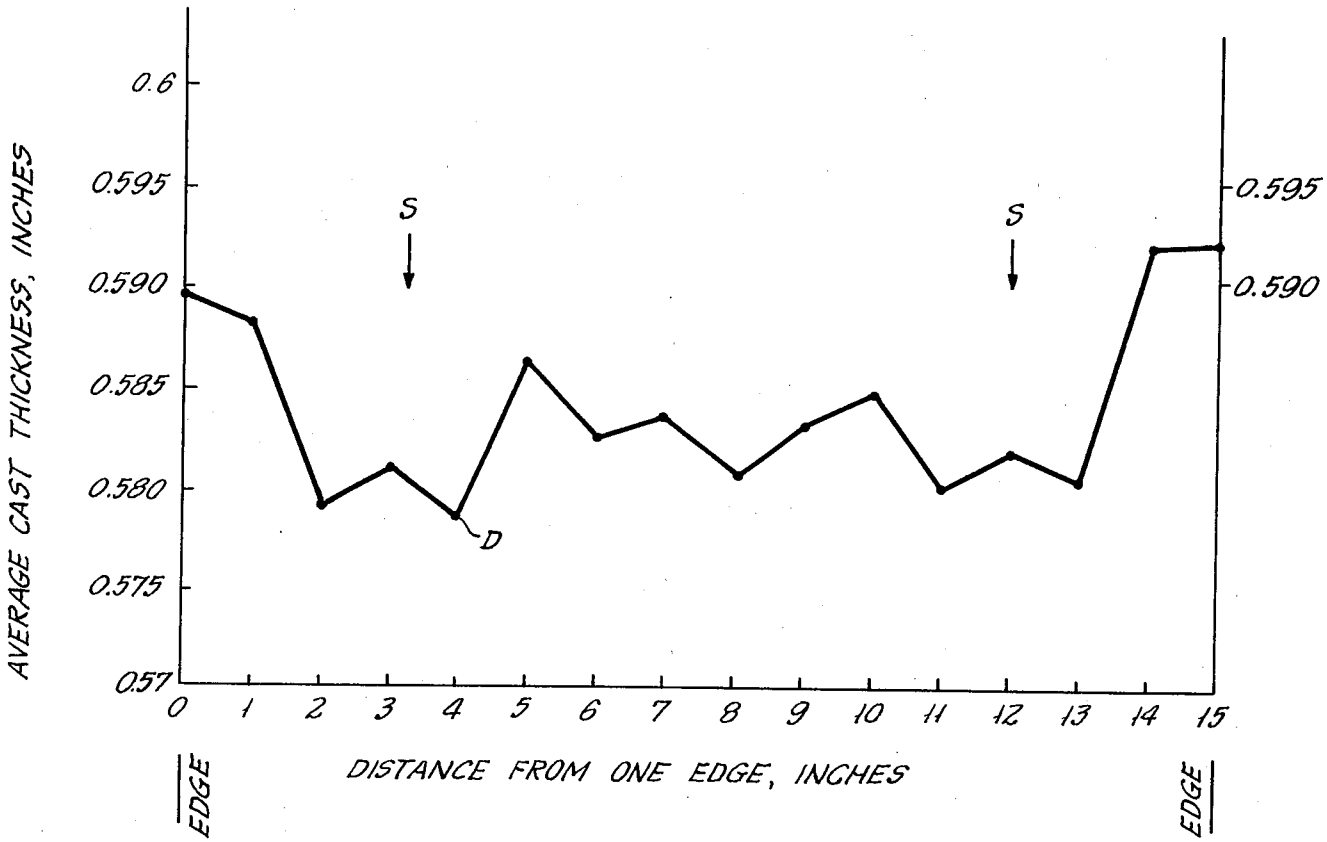
FIG. 5 is a plotted chart showing average thickness across the profile of a typical prior art slab with the vertical scale exaggerated.

As seen in FIG. 5 this test slab had a nominal thicknes of 0.600 of an inch, but its actual maximum thickness when cooled to room temperature was slightly above 0.592 of an inch. The two major longitudinal sinkage bands S are indicated by the arrows pointing to them, and the resultant as-cast slab at room temperature illustrates the dog-bone phenomenon. Since this slab had a width of 15 inches and a nominal thickness of 0.600 of an inch, its width-to-thickness ratio was 25. In the background section above, it was explained that these sinkage bands were centered typically at a distance of three to seven times the slab thickness from either edge. Three times 0.600" is 1.8". Seven times 0.600 is 4.2". The reader will note that the left sinkage band S begins at about 1.8 inches from the left edge and ends at about 4.2 inches therefrom. Similarly, the right sinkage band begins at about 13.2 (namely 1.8 inches from the right edge) and ends at about 10.8 (namely 4.2 inches from the right edge). The maximum sinkage point D (FIG. 5) has a thickness reading of 0.578 of an inch, which is 0.014 of an inch below the maximum thickness of 0.592 of an inch.

EXAMPLE II

When casting this same aluminum alloy 3105 at the same nominal thickness using edge dams assembled from similar steel dam blocks having an insulative refractive ceramic coating of zirconia about 0.012 of an inch thick overlying the refractory metal alloy base layer of nichrome about 0.006 of an inch on their chamfered, grit-blasted, inner faces as described above, the occurrence of sinkage decreased to 0.004 inch (0.1 mm), a decrease of about 70 percent. In this comparative test, the aforementioned problems that followed upon shrinkage were correspondingly proportionately reduced by about 70 percent, a dramatic improvement of about 2.3 times.

Flame-spraying of the edge-dam blocks 34 with an insulative refractory ceramic such as zirconia overlying nichrome meets all of the following essential conditions. The resultant dual-layer fused monolithic refractory coating (1) is strongly adherent to the base metal of the dam blocks; (2) provides appropriate thermal insulation to produce a dramatic improvement with respect to the problems discussed; (3) is resistant to mechanical damage—i.e., spalling and wear—in thicknesses great enough to provide the desired thermal insulation, (4) is resistant to thermal shock, and finally (5) is effectively non-wettable by molten metal.

The edge-dam blocks may, alternatively, be made by sintering powder that consists of a mixture of metal with non-metallic substances such as ceramic or cermetallic material.

Reducing the freezing rate at the edges of the mold is attainable by drastically heating the edge-dam blocks along both edges of the casting region C during casting so as to effectively reduce the temperature drop between the freezing metal and the dam blocks. The edge-dam blocks are heated to a temperature of at least 50 percent of the freezing point of the metal being cast, as measured on the Fahrenheit scale, but not less than 450 degrees Fahrenheit. This method of heating the blocks for example by Cal-Rod heaters extending longitudinally adjacent to the moving edge dams where they are travelling along the casting zone C will be mostly applicable to casting metals of relatively low melting point such as lead and zinc alloys.

One of the most visible characteristics of the fused zirconia over nichrome coating in the continuous casting process is its non-wettability by the molten metal. Freshly frozen metal, which normally adheres to the bare metal portion of the dam block, has practically no adhesion to the fused zirconia refractory coating. This non-wetting phenomenon may be readily observed by immersing a single, partially coated dam block into a bath of molten aluminum briefly and then extracting it, whereupon gravity will slough the aluminum off of the zirconia-coated surface, but not off of other surfaces. Thus, in a continuous casting machine the slightest disturbance of dam blocks coated as described above with fused zirconia will loosen the blocks from metal that is already frozen sufficiently to be stable, resulting in reduced heat transfer. The edge dams 26 and 28 (FIG. 2) must routinely pass in sequence one-after-another above and below the banks of backup rollers 32 (FIG. 2), being separated from them only by casting belts 16 and 24 that are flexible enough to allow the blocks 34 to be individually vibrated or oscillated slightly by their sequential passage past these rollers. Such jiggling or wobbling will break the close thermal contact between each individual dam block and the freshly frozen metal. In addition, the slight movement allows some air to enter the now irregular and enlarging gap, and the non-wetting property of the fused zirconia will facilitate this effective breaking of thermal contact, thereby dramatically reducing the rate of heat transfer from each edge of the strip or slab being cast into the dam blocks.

Figure 9:
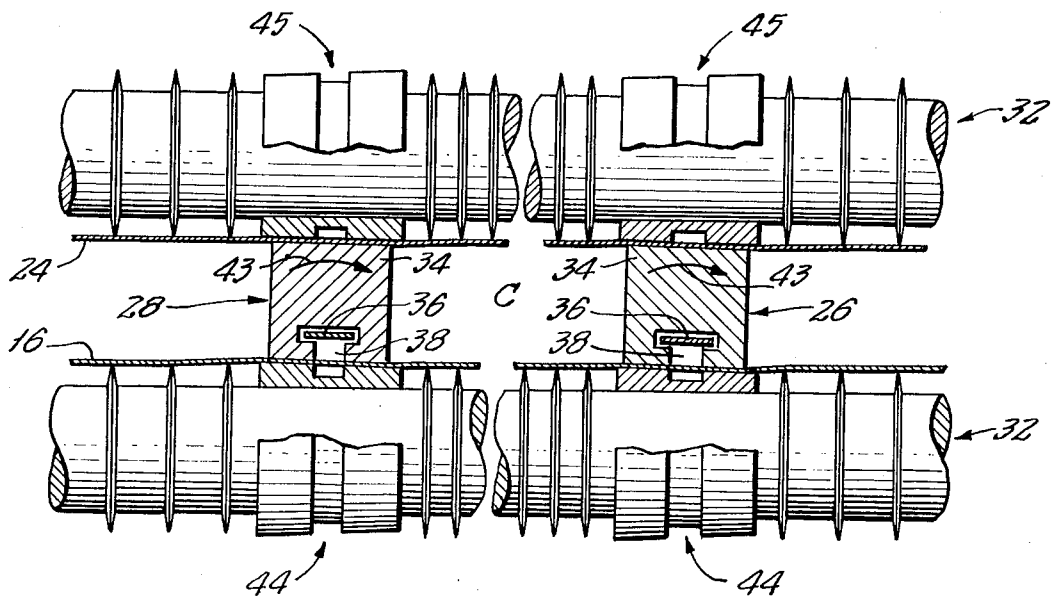
FIG. 9 is a view similar to FIG. 2 with the addition of tapered collars on the backup rollers for "jiggling" the edge dams. The taper is exaggerated for illustration.

This mechanical process of breaking thermal contact of dam blocks, with or without fused zirconia coating, may readily be augmented by the use of tapered collars 44 and 45 on the backup rollers, as shown in FIG. 9. On the lower backup roller the tapered collars 44 have their larger diameter at the left. Conversely, on the opposed upper backup roller the tapered collars 45 have their larger diameter to the right. Consequently, the two edge-dam blocks 34 are each being tilted in a clockwise direction as shown by the arrows 43 in FIG. 9. On the next pair of opposed lower and upper backup rollers the collars 44 are on top, and the collars 45 are on bottom causing the blocks to tilt in a counterclockwise direction, and so forth along the casting zone C. In this way, the dam blocks are made to tilt to and fro about a longitudinal line parallel to the pass line as they travel through the machine along the edge of the casting zone. Such tapered collars are especially useful in the middle third of the length of casting zone C as seen in FIG. 1, since upstream of the middle third the frozen shell is not yet in a stable state, and downstream of the middle third the tilting process of block separation from the frozen shell will already have been attained.

QUANTITATIVE TREATMENT OF FREEZING

The application of a precise analytical theory of molten metal freezing in the casting zone C is complicated and clouded by the existence of interfacial films, consisting of expelled atmospheric gases that were adsorbed onto mold walls, and gases resulting from the evaporation or decomposition of the liquid component of coating or of traces of oil left on the mold surfaces, as well as any films of metallic oxide on the freezing metal or on the dam blocks. Moreover, the travel of surges of heat through substantial thicknesses of solid material such as edge-dam blocks of continuous casters is not subject to simple and precise calculation. As for the gases before they escape, such gases are apt to dominate the rate of heat transfer, slowing it to substantially below what simple theory might otherwise suggest. The insulating value or thermal resistance R of such interfacial gas films cannot be directly observed but must be quantitatively inferred or derived from the difference between simple theory and practice.

To start with known facts, zirconia has a conductivity K of 7 to 8 Btu-inches per square foot per hour per degree Fahrenheit, where the inches are inches of thickness in the direction of heat flux. The latter figure applies at higher temperatures. Calling K 8, and dividing it by a specific coating thickness (in inches) yields a conductance "k" for that thickness. Assume a thickness of 0.004 inch, which is about the minimum useful thickness for the zirconia insulative refractory ceramic; then the conductance "k" is 2,000 Btu/sq ft/hr/°F.

Again, assume a zirconia thickness of 0.012 inch; then "k" equals 667 Btu/sq/ft/hr/°F. The reciprocal is the thermal resistance R, which in this example is 0.0015 degrees-Fahrenheit-hours-square-feet per Btu. R-values can be added for determining total cumulative resistance of layers and films to the conduction of heat along a path passing in sequence through the layers and films.

In laboratory tests with molten aluminum against dam blocks made of steel and having effectively 0.012 inch of zirconia on them overlying nichrome as described above, the thickness of aluminum frozen in 1 to 4 seconds indicates that the apparent value of "k" of the zirconia along with everything else in the heat conduction path is about 450 (R=0.0022). Subtracting 0.0015 as the known R of the 0.012 inch thick zirconia coat results in an R of about 0.0007 for interfacial films, together with some resistance (and thermal inertia) of the steel of the dam blocks against the dual-layer fused monolithic coating of nichrome and zirconia on the dam blocks.

The aluminum freeze-rate test was repeated on uncoated steel blocks. Against the bare steel surfaces of dam blocks, the apparent "k" of the films and the steel, as discussed above, approaches 600 (R=0.0017).

In these molten aluminum freeze-rate laboratory tests, the ratio of 450 to 600 indicates that the employment of this fused zirconia coating slows the effective rate of heat transfer to a value of less than 80 percent roughly 75 percent of what the rate would have been, absent the employment of the fused zirconia.

THEORIES AS TO WHY THE INVENTION WORKS

The reduction in sinkage or dog-bone cross-section and in related problems exeeds what a simple consideration of relative heat transfer would lead one to expect. Indeed, at first glance, there should be no relation between heat transfer at the edge of the product, and bands of sinkage centered at three to seven (sometimes up to nine) product thicknesses from each edge. How then can such results relatively far from the edge be explained?

The shrinkage areas or hot bands seem mainly not to be due to belt distortion. It is not merely that the use of belt preheating etc. has largely eliminated the thermal distortion of belts. There are new facts to consider. (1) The depth of the shrinkage bands S tends to be greater during the casting of that alloy which displays the greater shrinkage upon freezing, such as aluminum alloyed with 1.8 percent by weight of magnesium, as compared with the lesser shrinkage of 3105 aluminum alloy. If it were a matter of belt distortion, why would the belts distort more with one alloy than with another? Therefore, the conclusion appears to be that the greater dog-bone phenomenon occurring with the alloy having the greater shrinkage upon freezing is due to the greater shrinkage, not due to belt distortion. (2) An increase in casting width (at the same thickness), i.e., a greater width-to-thickness, increases the width of the practically flat center section of the cast slab but leaves the margin regions, includinq the shrinkaqe bands S, unchanged in the main. Quite differently, the belt-distortion effects previously experienced in the prior art occurred largely in the form of longitudinal flutes distributed approximately uniformly all the way across the cast slab. Again (3) thicker casting belts make little difference in the dog-bone phenomenon, when tested. In the prior art, the pattern of belt distortion as seen in the cast slab would always change and decrease substantially with increase in belt thickness. Moreover, (4) adjustment of belt preheating steam within normal working limits does not influence the dog-bone pattern of shrinkage. Finally (5) the sinkage bands S or hot bands are 80° to 100° F. (45° to 55° C.) hotter than the adjoining thicker areas of the cast slab. This large temperature difference would not occur if the hot-band areas S were to lay fully and uniformly against correspondingly distorted belts.

What, then, does cause these longitudinal shrinkage areas or hot bands S? In other words, what is causing the dog-bone cross-section configuration? The answer, in accordance with our theories, requires analysis of the freezing process. We theorize that the basic reason for the sinkage or hot bands S is that molten metal is being withdrawn (sucked) from below the surface in the region of sinkage S, through the still more or less molten middle plane—some of it being sucked toward the nearest edge dam 26 or 28, and some of it being sucked toward the area of final freezing, just downstream.

But, metal generally shrinks when it freezes. Why then should the shrinkage show up especially at one localized place rather than another? Our theoretical conclusion is that the shrinkage occurs in the two localized sinkage bands S, because a localized region H (FIG. 6) below each longitudinal sinkage band S of the cast slab product P is, at the moment just before its final freezing, being exhausted by suction of liquid metal feeding toward a sector of nearly three quadrants—that is, toward the roughly 250 degrees of arc constituting the sector of adjacent freezing metal and marked 250 in FIG. 6. Moreover, feeding of replenishment molten metal (make-up metal) has to come from the remaining (partly) molten sector of barely one quadrant—that is, from the sector of roughly 110 degrees of arc indicated at 110 in FIG. 6.

Figure 7:
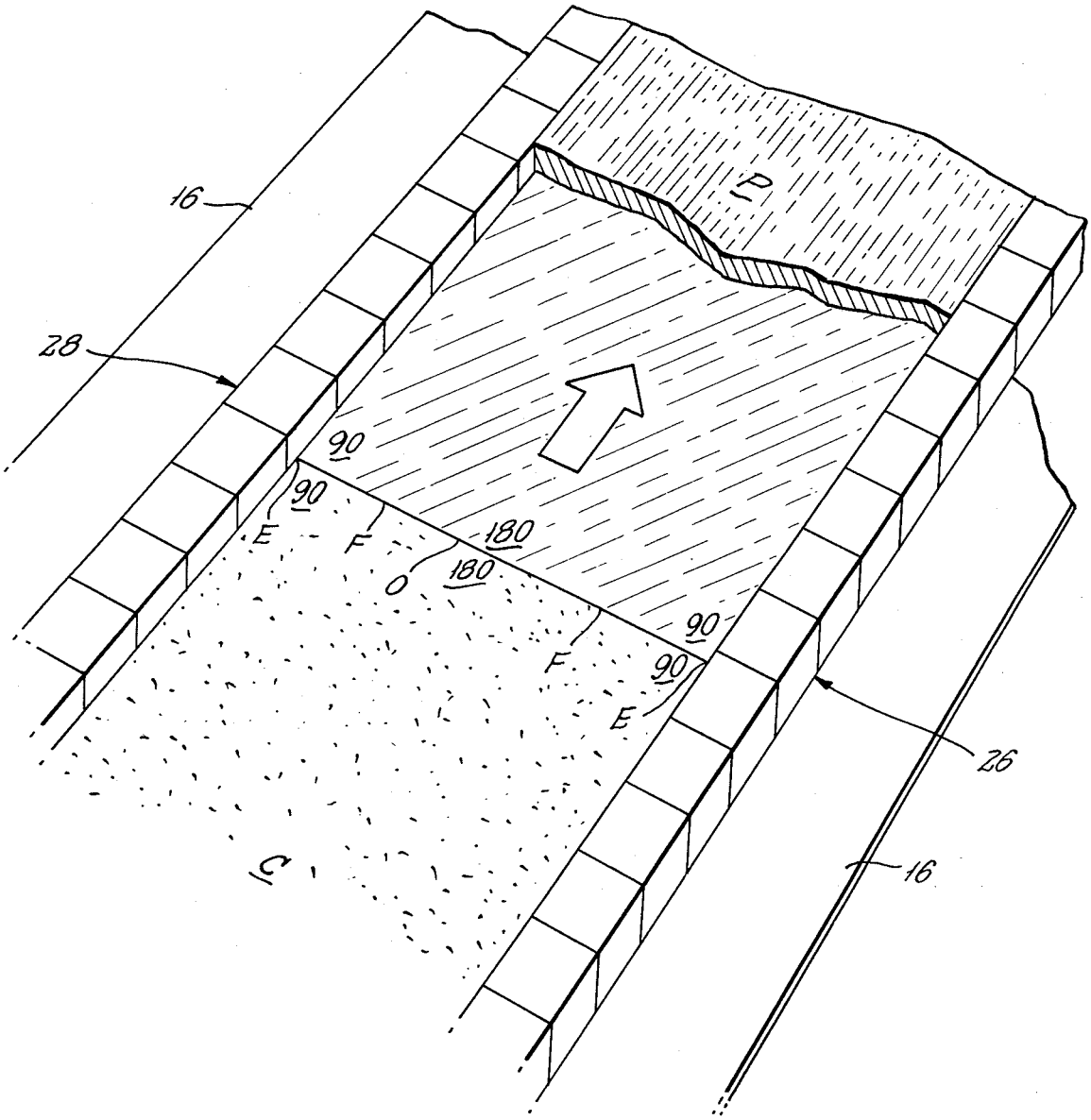
FIG. 7 is a view similar to FIG. 6 illustrating our current understanding about the occurrence of solidification when heat is appropriately being extracted in balanced relationship through the casting belts and edge dams from the metal being cast.

Let us contrast this with the situation under quite different theoretical conditions, as indicated in FIG. 7. For theoretical argument's sake, suppose that there were no heat extraction at the edges of the cast slab product P; suppose that the edge dams 26 and 28 have been heated so hot as to neither accept heat from, nor afford heat to, the freezing metal. In that case heat would be transmitted only through the casting belts 16 (and 24); thus, freezing across the cross section of the cast slab product P should be uniform. The freezing would be nearly complete along roughly a straight line extending across the width of the slab. This line may be referred to as the straight-line freezing front F (FIG. 7). Shrinkage during freezing would then be fed by make-up metal from the molten metal upstream. Thus, the feeding of make-up molten metal would be as adequate at one region of the freezing front F as at another.

Points along the middle of the freezing front F, such as point O, have a sector consisting of two quadrants, 180 degrees of arc, upstream to draw on for the feeding of make-up liquid metal, for the benefit of the nearly frozen metal extending through the other two quadrants—the other 180 degrees of arc. Both the feeding (make-up) sector and the freezing sector are marked 180 in FIG. 7. At the edges, at points E, there would be only one quadrant of 90° to supply molten make-up metal, but similarly there would only be one quadrant of 90° of freezing metal to draw the molten metal toward itself. The feeding and freezing quadrants are marked 90. Thus, the hypothetical situation illustrated in FIG. 7 would be one of symmetry throughout; supply would match demand all along the freezing front F extending across the width of the casting zone C. Consequently, in theory no localized sinkage should occur.

Figure 6:
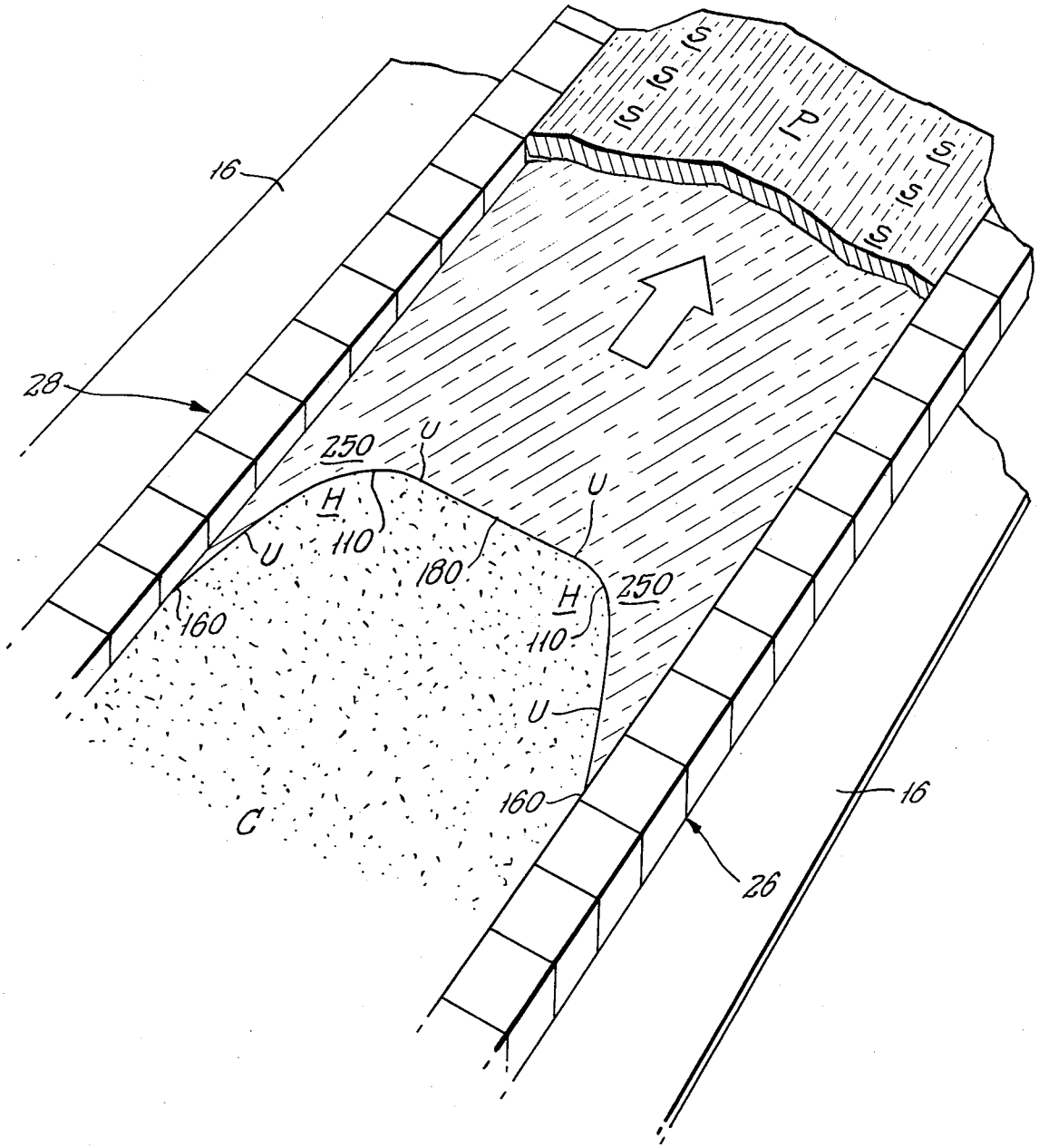
FIG. 6 is a perspective view of the mold region, partially in cross section, the upper casting belt and its associated mechanism being removed, showing our current understanding about the area in which final solidification occurs when the prior art edge dams are too rapidly extracting heat from the metal being cast.

This uniform matching of supply and demand does not happen in accordance with our theory when substantial heat is being extracted also through the edges of the cast slab P. The extra heat extraction through the edges causes the edges to freeze early and wide, as shown in FIG. 6. In our theory of what is occurring to cause the dog-bone phenomenon of FIGS. 3 and 5, we conclude that the freezing front (FIG. 6) is not a straight line across the width of the slab. Rather, it is a U-shaped line as at U in FIG. 6, with its two legs pointing upstream and with the ends of the U touching the side dams 26 and 28 at points 160 where the molten metal first touches them. (The angle between the side dams and the upstream ends of the legs of the U-shaped freezing front is about 160° as seen in FIG. 6.)

Please observe again that, at the rounded corners H of the U-shaped freezing front U, the already frozen areas occupy a sector 250 of nearly three quadrants, downstream and sideways, which, in their final freezing, are demanding molten metal to make up their shrinkage. The needed molten make-up metal can come only from the residual molten sector, which is the remaining quadrant of 110° roughly—that is, from diagonally upstream. The center region of this generally U-shaped freezing front U is approximately straight as indicated at 180 in FIG. 6, and thus supply and demand are approximately matched near the mid-region 180 of a slab as shown having a relatively large width/thickness ratio, for example 24.

In accordance with our theory, the next two questions arise. Why should this situation cause a sink starting at H, so long as that open quadrant 110 really has molten metal in it? Is there resistance to the travel of molten metal which might retard it? We have concluded that the answer is "yes." Even commercially pure metals generally freeze in minute dendrites or tree-like crystals, whose trunks extend generally parallel with the direction of heat flow. These dendrites become dense at some point in the freezing process, such that they afford resistance to the movement of molten metal. Yet the remaining molten metal on the frozen side of the freezing front continues to become frozen and to shrink, demanding more influx of make-up molten metal until all is frozen. And that extra liquid make-up metal has to be drawn through a "forest" of dendrites, and the forest is becoming thicker and more dense as the freezing proceeds.

In accordance with our theory, the effect of any initial sinkage at the two localities H is cumulative and becomes worse! When belt contact is lost in a limited area H due to the sinkage of the metal down away from the cooled upper belt 24, then that sunk area stays hot, i.e. remains at higher temperature than nearby non-sunk regions. Thus, the initially sunk region remains partially molten longer than nearby areas. Thus, the initially sunken region becomes the "make-up reservoir of last resort" to make up the shrinkage of the finally freezing nearby areas, thereby sinking more and losing belt contact more decisively in the process.

The above theoretical analyses are dealing with the behavior of freezing molten metals which freeze at the same temperature (freezing point) throughout, namely, dealing with metals without significant alloy constituents. We will now explain why we believe our theory also applies to alloys or impure metals. Instead of freezing at just one temperature, freezing point, impure metals or alloys exhibit a range of freezing temperatures. These ranges may or may not be wide. The combinations of constituents or impurities of higher freezing points tend to segregate at minute local sites and to freeze early during the cooling process. Then, their presence has an effect similar to that of a sponge saturated with liquid, or of a suspension like grains of sand and liquid. In such impure metals or alloys, the minute frozen sites correspond with grains of sand in the illustration, while the liquid corresponds to the molten residue segregated into a combination of lower freezing point constituents. The last composition of constituents to freeze is called the "eutectic."

Thus, we believe that the extended range of freezing temperatures in impure metals or alloys leaves the freezing metal in a mushy state for longer while it cools. We hypothesize that resistance to the flow of make-up molten metal, i.e. resistance to the sucking of liquid shrinkage make-up metal, in an area of high demand and limited internal access, causes the sunken hot bands S—that is, the dog-bone cross-section—in the cast slab P. The localized region H where the sinkage initiates remains more or less fixed in space, remaining stationary with respect to the casting machine. (Like a standing wave in a flowing river.) The metal being cast is travelling past this fixed location H of initial sinkage, and the result is two rather straight valleys of sinkage S in the cast product, extending on downstream from points H toward the output end of the machine, as indicated in FIG. 6 at S.

Figure 8A:
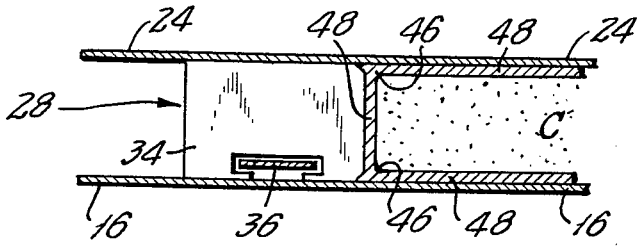
FIG. 8A–8C are partial cross-sections illustrating conditions within the metal being cast caused by the contractions of progressively thicker frozen shells surrounding the still molten core.
Figure 8B:
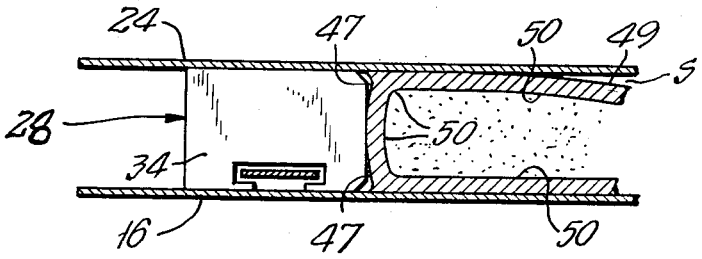

Partial confirmance of the probable correctness of our theories we now see from previously puzzling phenomena observable in the product. These phenomena may explain in part such hot bands S and the associated dog-bone cross-section. We have noted many times in continuous casting in twin-belt machines that internal mold corners of 90-degree angle (corresponding to the corners at 46 in FIG. 8A) often yield castings in which the outside cast surfaces near the right angle corners do not remain straight as shown in FIG. 8A. Instead, the outside cast surfaces bow toward each other, as shown at 47 and 49, in FIG. 8B. We explain these effects as follows: A thin shell 48 first freezes against the mold walls, as indicated in FIG. 8A. This shell cools fast and far gaining undue mechanical strength too fast. It shrinks but does not distort. But it cools and shrinks down to the point where it will not cool and shrink much more, becoming relatively strong. The next internal shell 50 (FIG. 8B) to freeze is welded to the first shell 48, but this inner shell 50 does its shrinking after the first shell has mostly completed its own shrinking. Thus the later-occurring shell 50 finds itself in tension as it cools. The result is for the inner shell under tension to bow inward the formerly straight lines of the first shell 48. The process of distortion continues as successive internal layers become frozen. There is the beginning of a sinkage S in FIG. 8B. In other words, what is occurring at 46 and 47 is reflecting itself far inward at a location S which is more than three times the product thickness away from the side dam 28. (FIGS. 8B and 8C are drawn for clarity of illustration and not to scale.)

Figure 8C:
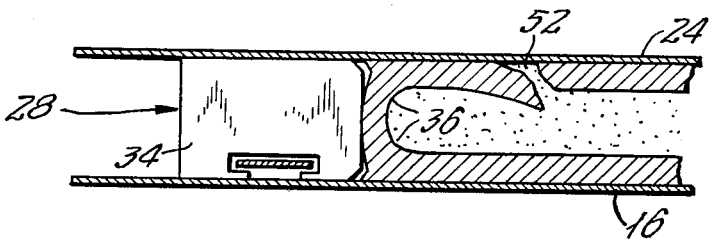

Under certain conditions this inner shell shrinkage tension bending of the outer shell and the initiating sinkage S is extreme enough to cause the surface to break as shown at 52 in FIG. 8C, allowing fresh molten metal to leak past the break and to form an uneven dike 52.

In summary, if the dam blocks are not effectively insulated for controlling heat transfer, then uncontrolled or random rapid freezing results along the edge surface 47 and in the corners 46. The solid edge surface 47 now acts as a fulcrum or buttress affording its strength for leverage to any frozen cantilevered shells extending away from the edge, thereby facilitating the inward bending occurring at 49, which is located far inward from the edge dam 28, and may facilitate the initiation of the sinkage S which is thereafter cumulative, because of lost contact with the upper belt 24 as explained above.

On the other hand, through the application of effective refractory insulation to the edge dam blocks as set forth above, the attainment of unduly early thickness and strength of the freezing corners 46 and edges 47 in the product is controlled or delayed. With such edge-controlled heat transfer improvement, any bending stress occasioned by inner shell tension that occurs near the corners could not be backed up by cantilevered strength or fulcrum leverage from such corners sufficient to have any appreciable effect at the trouble-zone S, which is somewhat remote from the edge of the product. Lacking that leverage, the troublesome sinks do not get started.

That is, we have concluded that random uncontrolled freezing at the edges near the side dams 26 and 28 is strong enough to swing the cantilevered shells downwardly away from the upper belt at 49 (FIG. 8B) and so to cause these hot bands and dog-bone cross-sectional phenomena. The solution entails undercutting the fixed ends of the cantilevers by effectively controlling heat transfer at the critical edge-dam faces, which are in continuous contact with the metal being cast.

Regardless of whether our theories are correct or not, the use of the dual-layer fused monolithic zirconia and nichrome coating 42 (FIG. 4) on the chamfered grit-blasted inner faces 35 of the edge-dam blocks will provide the advantages as described above.

The examples and observations stated herein have been the results of work with molten aluminum and copper and their alloys. However, this invention appears applicable to the continuous casting of any metal or alloy composition which shrinks or decreases in volume during or after freezing.

Although specific presently preferred embodiments of the invention have been disclosed herein in detail, it is to be understood that these examples of the invention have been described for purposes of illustration. This disclosure is not to be construed as limiting the scope of the invention, since the described methods and apparatus may be changed in details by those skilled in the art without departing from the scope of the following claims.

We claim:

1. In the method for continuously casting metal product directly from molten metal, wherein the molten metal is introduced into a moving mold, said moving mold being defined between opposed moving mold surfaces and laterally defined by first and second traveling edge dams consisting of flexible strings of dam blocks, the improvement comprising:

reducing the rate of heat transfer from the freezing metal to the edge-dam blocks to a value of less than 80 percent of the said rate against either adjacent mold surface.

2. The method of claim 1 wherein the heat transfer reducing step comprises, prior to casting the metal product:

applying an intermediate layer of refractory metal to those faces of the said edge-dam blocks normally contacted by molten metal; and applying a coating of molten insulative refractory ceramic to the intermediate layer, said insulative refractory ceramic being non-wetting with respect to the metal being cast.

3. The method as claimed in claim 2, in which:

the said insulative refractory ceramic is zirconia.

4. The method for continuously casting metal product of a thickness between ¼ inch (6 mm) and 3 inches (75 mm) and of a width at least four times its thickness, directly from molten metal, wherein the molten metal is introduced into a moving mold, said moving mold being defined between opposed moving mold surfaces and laterally defined by first and second traveling edge dams consisting of flexible strings of blocks mainly metallic, the method comprising:

reducing the rate of heat transfer from the freezing metal to the edge-dam blocks to a value of less than 80 percent of the said rate against either adjacent mold surface.

5. The method as claimed in claim 4 for casting a relatively wide slab metal product directly from molten metal, said slab having a width-to-thickness ratio of at least about twenty-five for avoiding longitudinal bands of sinkage located in the slab product at a distance of three to seven times the slab product thickness inwardly from the traveling edge dams for avoiding such sinkage deformation of the relatively wide slab product.

6. The method as claimed in claim 4, in which:

the reduction in heat transfer is achieved by means of, prior to casting the metal product:

applying an adherent intermediate layer of refractory metal to those faces of the said edge-dam blocks which will normally be contacted by molten metal, and applying an adherent coating of molten insulative refractory ceramic to the refractory metal on the said edge-dam blocks on the faces which will normally be contacted by molten metal, the said insulative refractory ceramic being non-wetting with respect to the metal being cast.

7. The method as claimed in claim 6, in which:

the said insulative refractory ceramic is zirconia.

8. The method of continuously casting metal product of a thickness between ¼ inch (6 mm) and 3 inches (75 mm) and of a width at least four times its thickness, directly from molten metal, wherein the molten metal is introduced into a moving mold, said moving mold being defined between opposed moving mold surfaces and laterally defined by first and second traveling edge dams consisting of flexible strings of blocks mainly metallic, the method comprising:

reducing the rate of heat transfer from the freezing metal to the said edge-dam blocks to a value of less than 80 percent of the said rate against uncoated edge-dam blocks consisting of similar base material similarly placed.

9. The method as claimed in claim 8, in which:

the reduction in heat transfer is achieved by means of, prior to casting the metal product:

applying an adherent intermediate layer of refractory metal to those faces of the said edge-dam blocks which will normally be contacted by molten metal, and applying an adherent coating of molten insulative refractory ceramic to the refractory metal on the said edge-dam blocks on the faces which will normally be contacted by molten metal, the said insulative refractory ceramic being non-wetting with respect to the metal being cast.

10. The method for continuously casting metal product of a thickness between ¼ inch (6 mm) and 3 inches (75 mm) and of a width at least four times its thickness, directly from molten metal, wherein the molten metal is introduced into a moving mold, said moving mold being defined between opposed moving mold surfaces and laterally defined by first and second travelling edge dams consisting of flexible strings of blocks mainly metallic the method comprising, prior to casting the metal product:

applying an adherent intermediate layer of refractory metal to those faces of the said edge-dam blocks which will normally be contacted by molten metal, and applying an adherent layer of molten insulative refractory ceramic to the refractory metal on those faces of the dam blocks which will normally be contacted by molten metal, said insulative refractory ceramic being non-wetting with respect to the metal being cast, followed by:

causing the said edge-dam blocks to be jiggled or vibrated while in contact with the freezing product, whereby:

the rate of heat transfer during casting is reduced to a value of less than 80% of said rate against untreated edge dam blocks of similar base material similarly placed.

11. The method for continuously casting metal product of a thickness between ¼ inch (6 mm) and 3 inches (75 mm) and of a width at least four times its thickness, directly from molten metal, wherein the molten metal is introduced into a moving mold, said moving mold being defined between opposed moving mold surfaces and laterally defined by first and second traveling edge dams consisting of flexible strings of blocks mainly metallic, the method comprising, prior to casting the metal product:

applying an adherent intermediate layer of refractory metal to those faces of the said edge-dam blocks which will normally be contacted by molten metal, and applying an adherent layer of molten insulative refractory ceramic to the refractory metal on those faces of the said edge-dam blocks which would normally be contacted by molten metal, the said insulative refractory ceramic being non-wetting with respect to the metal being cast, followed by:

hardening the remaining faces of the said edge-dam blocks by the process of nitriding, without any masking of previously coated surface, whereby:

the rate of heat transfer during casting is reduced to a value of less than 80% of said rate against untreated edge-dam blocks of similar base material similarly placed, while the said edge-dam blocks are rendered long wearing at minimal cost.

12. The method for continuously casting metal product of a thickness between ¼ inch (6 mm) and 3 inches (75 mm) and of a width at least four times its thickness, directly from molten metal, wherein the molten metal is introduced into a moving mold, said moving mold being defined between opposed moving mold surfaces and laterally defined by first and second travelling edge dams consisting of flexible strings of blocks mainly metallic, the method comprising:

heating the said edge-dam blocks to a temperature of at least 50 percent of the freezing point of the metal being cast, as measured on the Fahrenheit scale, but to not less than 450 degrees Fahrenheit, whereby:

the rate of heat transfer during casting is reduced to a value of less than 80% of said rate against untreated edge-dam blocks of similar base material similarly placed.

13. The method for continuously casting metal product of a thickness between ¼ inch (6 mm) and 3 inches (75 mm) and of a width at least four times its thickness, directly from molten metal, wherein the molten metal is introduced into a moving mold, said moving mold being defined between opposed moving mold surfaces and laterally defined by first and second traveling edge dams consisting of flexible strings of blocks mainly metallic, the method comprising:

causing the said edge-dam blocks to wobble in relation to the freezing metal product for breaking close thermal contact between each block and the freshly frozen metal, whereby:

the rate of heat transfer during casting from the metal into the blocks is reduced to a value of less than 80% of the value occurring with similar blocks similarly placed without such wobbling.

14. The method for continuously casting metal product of a thickness between ¼ inch (6 mm) and 3 inches (75 mm) and of a width at least four times its thickness, directly from molten metal, wherein the molten metal is introduced into a moving mold, said moving mold being defined between the mold surfaces of two opposed, cooled moving endless flexible casting belts passing over backup rollers and laterally defined by first and second traveling edge dams consisting of flexible strings of blocks mainly metallic, the method comprising:

reducing the rate of heat transfer from the freezing metal to the said edge-dam blocks to a value of less than 80 percent of the said rate against either adjacent flexible casting belt.

15. The method as claimed in claim 14, in which:

the reduction in heat transfer is achieved by means of, prior to casting the metal product:

applying an adherent intermediate layer of refractory metal to those faces of the said edge-dam blocks which will normally be contacted by molten metal, and applying an adherent coating of molten insulative refractory ceramic to the refractory metal on the said edge-dam blocks on the faces which will normally be contacted by molten metal, the said refractory insulative ceramic being non-wetting with respect to the metal being cast.

16. The method as claimed in claim 15, in which:

the said insulative refractory ceramic is zirconia.

17. The method for continuously casting metal product of a thickness between ¼ inch (6 mm) and 3 inches (75 mm) and of a width at least four times its thickness, directly from molten metal, wherein the molten metal is introduced into a moving mold, said moving mold being defined between the mold surfaces of two opposed, cooled moving endless flexible casting belts passing over backup rollers and laterally defined by first and second traveling edge dams consisting of flexible strings of blocks mainly metallic, the method comprising:

reducing the rate of heat transfer from the freezing metal to the edge-dam blocks to a value of less than 80 percent of the said rate against uncoated edge-dam blocks consisting of similar base material similarly placed.

18. The method as claimed in claim 17, in which:

the reduction in heat transfer is achieved by means of, prior to casting the metal product:

applying an adherent intermediate layer of refractory metal to those faces of the said edge-dam blocks which will normally be contacted by molten metal, and applying an adherent coating of molten insulative refractory ceramic to the refractory metal on the said edge-dam blcoks on the faces which will normally be contacted by molten metal, the said refractory insulative ceramic being non-wetting with respect to the metal being cast.

19. The method for continuously casting metal product of a thickness between ¼ inch (6 mm) and 3 inches (75 mm) and of a width at least four times its thickness, directly from molten metal, wherein the molten metal is introduced into a moving mold, said moving mold being defined between the mold surfaces of two opposed, cooled moving endless flexible casting belts passing over backup rollers and laterally defined by first and second traveling edge dams consisting of flexible strings of blocks mainly metallic, the method comprising, prior to casting the metal product:

applying an adherent intermediate layer of refractory metal to those faces of the said edge-dam blocks which will normally be contacted by molten metal, and applying an adherent layer of molten insulative refractory ceramic to the refractory metal on those faces of the said edge-dam blocks which will normally be contacted by molten metal, the said insulative refractory ceramic being non-wetting with respect to the metal being cast, followed by:

causing the said edge-dam blocks to be jiggled or vibrated while in contact with the adjacent freezing product, whereby:

the rate of heat transfer during casting is reduced to a value less than 80% of said rate against untreated edge-dam blocks of similar base material similarly placed.

20. The method for continuously casting metal product of a thickness between ¼ inch (6 mm) and 3 inches (75 mm) and of a width at least four times its thickness, directly from molten metal, wherein the molten metal is introduced into a moving mold, said moving mold being defined between the mold surfaces of two opposed, cooled moving endless flexible casting belts passing over backup rollers and laterally defined by first and second traveling edge dams consisting of flexible strings of blocks mainly metallic, the method comprising, prior to casting the metal product:

applying adherent intermediate layer of refractory metal to those faces of the said edge-dam blocks on the faces which will normally be contacted by molten metal, and applying an adherent layer of molten insulative refractory ceramic to the refractory metal on those faces of the said edge-dam blocks which will normally be contacted by molten metal, the said insulative refractory ceramic being non-wetting with respect to the metal being cast, followed by:

hardening the remaining faces of the said edge-dam blocks by the process of nitriding, without any masking of previously coated surface, whereby:

the rate of heat transfer during casting is reduced to a value of less than 80% of said rate against untreated edge-dam blocks of similar base material similarly placed, while the said blocks are rendered long wearing at minimal cost.

21. The method for continuously casting metal product of a thickness between ¼ inch (6 mm) and 3 inches (75 mm) and of a width at least four times its thickness, directly from molten metal, wherein the molten metal is introduced into a moving mold, said moving mold being defined between the mold surfaces of two opposed, cooled moving endless flexible casting belts passing over backup rollers and laterally defined by first and second traveling edge dams consisting of flexible strings of blocks mainly metallic, the method comprising:

heating the said edge-dam blocks to a temperature of at least 50 percent of the freezing point of the metal being cast, as measured on the Fahrenheit scale, but to a temperature of not less than 450 degrees Fahrenheit, whereby:

the rate of heat transfer during casting is reduced to a value of less than 80% of said rate against untreated edge-dam blocks of similar base material similarly placed.

22. The method for continuously casting metal product of a thickness between ¼ inch (6 mm) and 3 inches (75 mm) and of a width at least four times its thickness, directly from molten metal, wherein the molten metal is introduced into a moving mold, said moving mold being defined between the mold surfaces of two opposed, cooled moving endless flexible casting belts passing over backup rollers and laterally defined by first and second traveling edge dams consisting of flexible strings of blocks mainly metallic, the method comprising:

causing the said blocks to oscillate in relation to the freezing metal product for breaking close thermal contact between each block and the freshly frozen metal, whereby:

the rate of heat transfer during casting from the metal into the blocks is reduced to a value less than 80% of the rate of heat transfer from the metal into similar blocks similarly placed without oscillating.

23. The apparatus for continuously casting metal product of a thickness between ¼ inch (6 mm) and 3 inches (75 mm) and of a width at least four times its thickness, directly from molten metal, wherein the molten metal is introduced into a moving mold, said moving mold being defined by first and second traveling edge dams consisting of flexible strings of blocks mainly metallic, the apparatus comprising:

an adherent intermediate layer of refractory metal on those faces of the said edge-dam blocks which will normally be contacted by molten metal, and an outer adherent layer of molten insulative refractory ceramic on the layer of refractory metal on those faces of the said edge-dam blocks which will normally be contacted by molten metal, the thermal conductance of the said layer being no more than 3000 British thermal units per square foot per hour per degree Fahrenheit, the said insulative refractory ceramic being non-wetting with respect to the metal being cast, whereby:

the rate of heat transfer during casting is reduced to a value of less than 80% of said rate against untreated edge-dam blocks of similar base material similarly placed.

24. The apparatus as claimed in claim 23, in which: the said insulative refractory ceramic is zirconia.

25. Apparatus for continuously casting metal product of a thickness between ¼ inch (6 mm) and 3 inches (75 mm) and of a width at least four times its thickness, directly from molten metal, wherein the molten metal is introduced into a moving mold, said moving mold being defined between opposed moving mold surfaces and laterally defined by first and second traveling edge dams consisting of flexible strings of blocks mainly metallic, the apparatus comprising:

an intermediate layer of refractory metal which is adhered to those faces of the dam blocks which will normally be in contact with molten metal, and an outer adherent coating of insulative refractory ceramic on the layer of refractory metal on those surfaces which will normally be contacted by molten metal, said insulative refractory ceramic thickness being at least 0.003 inch (0.08 mm), the said insulative refractory ceramic being non-wetting in relation to the metal being cast, whereby:

the rate of heat transfer during casting is reduced to a value of less than 80% of said rate against untreated edge-dam blocks of similar base material similarly placed.

26. The apparatus as claimed in claim 25, in which:

the said insulative refractory ceramic is zirconia.

27. The apparatus as claimed in claims 23, 24, 25, or 26 in which:

at least one edge of the constituent material of the said dam blocks adjacent to their working faces is chamfered to relieve its sharpness, whereby:

the said layer of insulative refractory ceramic is protected from chipping.

28. Apparatus for continuously casting metal product of a thickness between ¼ inch (6 mm) and 3 inches (75 mm) and of a width at least four times its thickness, directly from molten metal, wherein the molten metal is introduced into a moving mold, said moving mold being defined between opposed moving mold surfaces and laterally defined by first and second traveling edge dams consisting of flexible strings of blocks mainly metallic, the apparatus comprising:

means to effect slight movement of some of the said blocks in relation to the freezing metal product, whereby:

the rate of heat transfer during casting is reduced.

29. Apparatus for continuously casting metal product of a thickness between ¼ inch (6 mm) and 3 inches (75 mm) and of a width at least four times its thickness, directly from molten metal, wherein the molten metal is introduced into a moving mold, said moving mold being defined between the mold surfaces of two opposed, cooled moving endless flexible casting belts passing over backup rollers and laterally defined by first and second traveling edge dams consisting of flexible strings of blocks mainly metallic, the apparatus comprising:

an adherent intermediate layer of refractory metal on those faces of the said edge-dam blocks which will normally be contacted by molten metal, and an outer adherent layer of molten insulative refractory ceramic on the layer of refractory metal on those faces of the dam blocks which will normally be contacted by molten metal, the thermal conductance of said layer being no more than 3000 British thermal units per square foot per hour per degree Fahrenheit, the said insulative refractory ceramic being non-wetting in relation to the metal being cast, whereby:

the rate of heat transfer during casting is reduced to a value of less than 80% of said rate against untreated edge-dam blocks of similar base material similarly placed.

30. The apparatus as claimed in claim 29, in which:

the said insulative refractory ceramic is zirconia.

31. Apparatus for continuously casting metal product of a thickness between ¼ inch (6 mm) and 3 inches (75 mm) and of a width at least four times its thickness, directly from molten metal, wherein the molten metal is introduced into a moving mold, said moving mold being defined between the mold surfaces of two opposed, cooled moving endless flexible casting belts passing over backup rollers and laterally defined by first and second traveling edge dams consisting of flexible strings of blocks mainly metallic, the apparatus comprising:

an intermediate layer of refractory metal adhered to those faces of the dam blocks which will normally be in contact with molten metal, and an outer adherent coating of insulative refractory ceramic on the layer of refractory metal on those surfaces of the edge-dam blocks which will normally be contacted by molten metal, said insulative refractory ceramic thickness being at least 0.003 inch (0.08 mm), the said insulative refractory ceramic being non-wetting in relation to the metal being cast, whereby:

the rate of heat transfer during casting is reduced to a value of less than 80% of said rate against untreated edge-dam blocks of similar base material similarly placed.

32. The apparatus as claimed in claim 31, in which:

the said insulative refractory ceramic is zirconia.

33. Apparatus for continuously casting metal product of a thickness between ¼ inch (6 mm) and 3 inches (75 mm) and of a width at least four times its thickness, directly from molten metal, wherein the molten metal is introduced into a moving mold, said moving mold being defined between the mold surfaces of two opposed, cooled moving endless flexible casting belts passing over backup rollers and laterally defined by first and second traveling edge dams consisting of flexible strings of blocks mainly metallic, the apparatus comprising:

an adherent intermediate layer of refractory metal on those faces of the said edge-dam blocks which will normally be contacted by molten metal, and an outer adherent coating of insulative refractory ceramic on the layer of refractory metal on those faces of the dam blocks which will normally be contacted by molten metal, the said insulative refractory ceramic being non-wetting with respect to the metal being cast, together with:

the said backup rollers in such capacity as to effect slight movement of the said dam blocks in relation to the freezing metal product, by the close moving proximity of the said blocks past the said rollers, whereby:

the rate of heat transfer during casting is reduced to a value of less than 80% of said rate against untreated edge-dam blocks of similar base material similarly placed.

34. The apparatus as claimed in claim 33, in which:

the said insulative refractory ceramic is zirconia.

35. The apparatus as in claims 29, 30, 31, 32, 33, or 34 in which:

at least one edge of the constituent material of the said dam blocks adjacent to their working faces is chamfered to relieve it of its sharpness, whereby:

the said insulative refractory ceramic is protected from shipping.

36. Apparatus for continuously casting metal product of a thickness between ¼ inch (6 mm) and 3 inches (75 mm) and of a width at least four times its thickness, directly from molten metal, wherein the molten metal is introduced into a moving mold, said moving mold being defined between the mold surfaces of two opposed, cooled moving endless flexible casting belts passing over backup rollers and laterally defined by first and second traveling edge dams consisting of flexible strings of blocks mainly metallic, the apparatus comprising:

slightly tapered conical collars on and concentric to the said backup rollers at points opposite the said edge dams, the collars being arranged so as to cause the said dam blocks to oscillate in slight rotation as they pass between the said backup rollers, whereby:

the rate of heat transfer during casting is reduced.

* * * * *